US007387089B2

(12) United States Patent
Peart et al.

(10) Patent No.: US 7,387,089 B2
(45) Date of Patent: Jun. 17, 2008

(54) WATER HEATER WITH CROSS-SECTIONALLY ELONGATED RAW FUEL JET PILOT ORIFICE

(75) Inventors: Jacob A. Peart, Wetumpka, AL (US); Haibo Fan, Lincoln, NE (US)

(73) Assignee: Rheem Manufacturing Company, New York, NY (US)

( * ) Notice: Subject to any disclaimer, the term of this patent is extended or adjusted under 35 U.S.C. 154(b) by 388 days.

(21) Appl. No.: 11/348,287

(22) Filed: Feb. 6, 2006

(65) Prior Publication Data

US 2006/0207524 A1 Sep. 21, 2006

Related U.S. Application Data

(63) Continuation-in-part of application No. 10/933,776, filed on Sep. 3, 2004, now Pat. No. 7,028,642.

(51) Int. Cl.
*F23N 5/10* (2006.01)

(52) U.S. Cl. ..... 122/14.31; 122/14.2; 431/80

(58) Field of Classification Search ..... 122/14.31, 122/14.2, 504; 431/18, 42, 75, 78, 80
See application file for complete search history.

(56) References Cited

U.S. PATENT DOCUMENTS

| | | | | |
|---|---|---|---|---|
| 84,675 A | | 12/1868 | Bronner | |
| 1,095,280 A | | 5/1914 | Keller | |
| 1,302,914 A | | 5/1919 | Goreau | |
| 1,805,066 A | | 5/1931 | Andrieux | |
| 2,985,386 A | | 5/1961 | Steinen | |
| 3,521,824 A | | 7/1970 | Wilcox | |
| 3,561,896 A | | 2/1971 | Riehl | |
| 3,834,856 A | | 9/1974 | James | |
| 3,913,846 A | | 10/1975 | Morris | |
| 4,192,642 A | | 3/1980 | Lempa | |
| 4,358,265 A | * | 11/1982 | Tanaka et al. | 431/76 |
| 4,392,813 A | * | 7/1983 | Tanaka et al. | 431/76 |

(Continued)

FOREIGN PATENT DOCUMENTS

| | | |
|---|---|---|
| JP | 2002106838 | 4/2002 |
| WO | WO 97/44621 | 11/1997 |

OTHER PUBLICATIONS

Mar. 30, 2005 New Zealand Examination Report (Corresponding to U.S. Appl. No. 10/933,776).

*Primary Examiner*—Gregory A Wilson
(74) *Attorney, Agent, or Firm*—Haynes and Boone, LLP

(57) ABSTRACT

A radiant gas burner within the combustion chamber of a water heater has a pilot flame created using a cross-sectionally elongated raw fuel jet that impinges on an interior surface portion of a flame holding outer burner wall portion, representatively of a metal wire mesh material, and is mixed within the burner with combustion air delivered thereto from outside the combustion chamber. The resulting fuel/air mixture passes outwardly through the impinged upon mesh wall portion, which functions as a pilot flame stabilizing structure, and is ignited to form a pilot flame on the exterior of the burner body. A thermocouple portion of a clogging detection system senses a change in the pilot flame shape caused by particulate clogging of the metal mesh material and responsively terminates further gas supply to the water heater.

33 Claims, 2 Drawing Sheets

U.S. PATENT DOCUMENTS 4,597,733 A 7/1986 Dean et al.
4,919,084 A 4/1990 Maurice
5,658,139 A 8/1997 Flanagan et al.
5,791,298 A 8/1998 Rodgers
6,139,311 A 10/2000 Bowman et al.
6,295,951 B1 10/2001 Valcic et al.
6,419,478 B1 * 7/2002 Kemp ..... 431/12
6,497,200 B2 12/2002 Stretch et al.
6,540,504 B2 4/2003 Kobayashi et al.
6,554,608 B1 4/2003 Bowman et al.
6,561,138 B2 5/2003 Kobayashi et al.
6,634,320 B2 * 10/2003 Grando et al. ..... 122/14.2
6,648,627 B2 11/2003 Dane
6,761,134 B1 7/2004 Trant
6,776,125 B2 * 8/2004 Stretch et al. ..... 122/14.1
2003/0015604 A1 1/2003 Kobayashi et al.
2003/0183177 A1 10/2003 Kobayashi et al.
2003/0188699 A1 10/2003 Valcic et al.
2004/0195402 A1 10/2004 Joshi

* cited by examiner

WATER HEATER WITH CROSS-SECTIONALLY ELONGATED RAW FUEL JET PILOT ORIFICE

CROSS-REFERENCE TO RELATED APPLICATION

This application is a continuation-in-part of U.S. application Ser. No. 10/933,776 filed on Sep. 3, 2004, now U.S. Pat. No. 7,028,642 such application being hereby incorporated herein in its entirety by reference.

BACKGROUND OF THE INVENTION

The present invention generally relates to fuel fired heating apparatus and, in a representatively illustrated embodiment thereof, more particularly provides a fuel-fired water heater having incorporated therein a specially designed raw fuel jet pilot structure and associated burner clogging detection apparatus.

Despite continuing improvements in the fuel efficiency of and reduction in undesirable operating emissions therefrom, modern fuel-fired water heaters still have various operational characteristics which are less than entirely satisfactory. For example, the burner pilots in most if not all conventional fuel-fired water heaters draw their combustion air from the area within the combustion chamber surrounding the pilot burner and its associated main burner. In some water heater combustion chamber configurations this air surrounding the pilot is diluted with exhaust gases. This undesirably reduces the amount of available oxygen for proper pilot combustion. With respect to this pilot-related problem, the water heater designer is faced with two conflicting design criteria— the need for the pilot to be close to the main burner for proper ignition thereof, and the need for the pilot to be near a clean combustion air source for proper pilot combustion.

Another design challenge associated with modern fuel-fired water heaters is that they typically operate in locations that are not regularly cleaned (for example, in attics, closets, basements, sheds, etc.). Due to the presence of various types of contaminants present in such locations, which tend to clog various components of the water heater such as its burner, the water heater must either be able to operate reliably and safely throughout its life, or, in the case of extreme contamination from clogging materials such as lint, dust and oil, needs to be designed to safely shut itself down before producing undesirably high levels of carbon monoxide caused by clogging of various components of the water heater.

As can be seen from the foregoing, a need exists for a fuel-fired water heater having improvements in the above-described areas. It is to this need that the present invention is primarily directed.

SUMMARY OF THE INVENTION

In carrying out principles of the present invention, in accordance with a representatively illustrated embodiment thereof, a fuel-fired heating appliance is provided with specially designed combustion apparatus illustratively comprising a wall structure defining a combustion chamber; a flame stabilizing structure disposed within the combustion chamber; fuel delivery apparatus operable to receive fuel from a source thereof and discharge the received fuel in the form of a raw fuel jet that impinges upon the flame stabilizing structure; and air delivery apparatus through which combustion air from outside the combustion chamber is flowable to the discharged fuel jet to form therewith a fuel/air mixture ignitable to create a flame extending outwardly from the flame stabilizing structure.

According to an aspect of the invention, the raw fuel jet is provided with an elongated cross-sectional shape, representatively by discharging it through an elongated rectangular orifice in a fuel delivery tube. The elongated cross-sectional shape of the discharged raw fuel jet serves to desirably stabilize the flame despite minor relative orientation variations between the orifice and the target flame stabilizing structure.

The heating appliance is illustratively a gas-fired water heater, but could alternatively be another type of fuel-fired heating appliance such as, for example, a boiler or an air heating furnace. In the depicted water heater the combustion apparatus also includes a main burner disposed in the combustion chamber, the main burner having a hollow body with an outer wall having fuel/air discharge openings therein. The pilot flame fuel is jet impinges against an interior surface of this outer wall, is mixed with the incoming combustion air within the main burner, and passes outwardly through the main burner discharge openings whereupon it is suitably ignited to form the pilot flame on the exterior surface of the outer wall, part of which defines the aforementioned flame stabilizing structure impinged upon by the discharged fuel jet.

In the illustrated water heater embodiment, the main burner is a radiant fuel burner with the outer wall portion thereof being a flame holding wall formed from a metal mesh material. However, the invention is not limited to a combustion system employing a radiant burner—other types of main burners may be utilized without departing from principles of the present invention, and apertured outer burner walls of other types, such as ceramic, porous, woven materials, etc., may be alternatively utilized if desired.

According to another aspect of the invention, the fuel-fired heating appliance is also provided with a clogging detection system which shuts down the burner, preventing the generation of either of its main and pilot flames, in response to sensing a clogging of the burner caused, for example, by particulate matter passing through the burner and plugging up its fuel/air discharge openings. In an illustrated embodiment thereof, this clogging detection system functions to sense burner clogging, by detecting an undesirable change in the shape of the pilot flame, and responsively closing a fuel valve controlling fuel flow to the burner and its associated pilot structure. Representatively, this sensing function of the clogging detection system is performed by a thermocouple positioned to be impinged upon by the pilot flame and operatively coupled to the fuel valve.

In accordance with a further aspect of the invention, a section of the apertured outer burner wall containing the portion thereof interiorly impinged upon by the pilot flame is more susceptible to clogging than the balance of the apertured outer wall of the burner, thereby increasing the sensitivity of the clogging detection system. In the illustrated mesh outer flame-holding wall embodiment of this aspect of the invention, the mesh spacing on the outer wall section interiorly impinged upon by the pilot flame is smaller than the mesh spacing of the balance of the outer wall.

DETAILED DESCRIPTION

Figure 1:
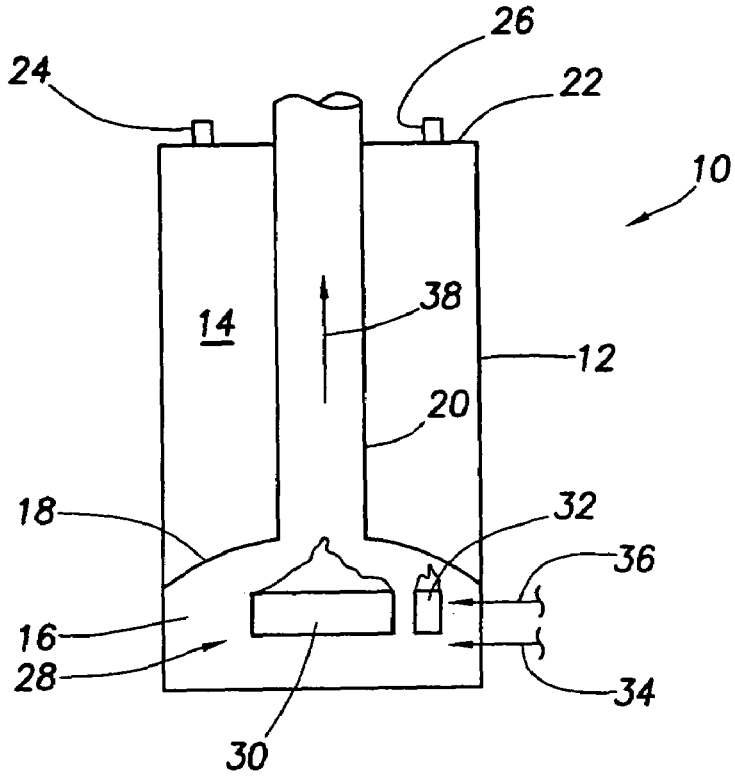
FIG. 1 is a schematic cross-sectional view through a representative fuel-fired water heater embodying principles of the present invention.

Schematically depicted in FIG. 1 is a fuel-fired heating appliance 10 which is representatively a gas-fired water heater, but which could alternatively be another type of fuel-fired heating appliance, such as, for example, a boiler or an air heating furnace, without departing from principles of the present invention. Water heater 10 has the usual insulated metal tank 12 adapted to hold a quantity of pressurized water 14 to be heated, and a combustion chamber 16 operatively disposed beneath a lower end wall 18 of the tank 12. A flue pipe 20 communicates with the combustion chamber 16 and extends upwardly therefrom through the water 14, passing upwardly through the upper end 22 of the tank 12. A cold water inlet pipe 24 and a hot water outlet pipe 26 are positioned on the upper end 22 of the tank 12 and communicate with the water 14 therein.

The water 14 in the tank 12 is heated by specially designed fuel burner apparatus 28 operatively disposed in the combustion chamber 16 and embodying principles of the present invention. As schematically depicted in FIG. 1, the burner apparatus 28 includes main and pilot burner portions 30,32 which are supplied with fuel 34 and primary combustion air 36 from outside the combustion chamber 16 in a manner subsequently described herein. During firing thereof the burner apparatus 28 creates hot combustion products 38 that flow upwardly through the flue 20 which transfers combustion heat therethrough to the water 14 to maintain it at a predetermined heated temperature.

The pressurized water 14, from a source thereof, is initially flowed into the tank 12 through the cold water inlet pipe 24 and heated as described above. As needed, the pressurized heated water 14 may be supplied to plumbing fixtures, such as sinks, showers, dishwashers and the like, via the hot water outlet pipe 26. Hot water discharged from outlet pipe 26 is automatically replaced with cold water flowed inwardly through inlet pipe 24 into the tank 12.

Figure 2:
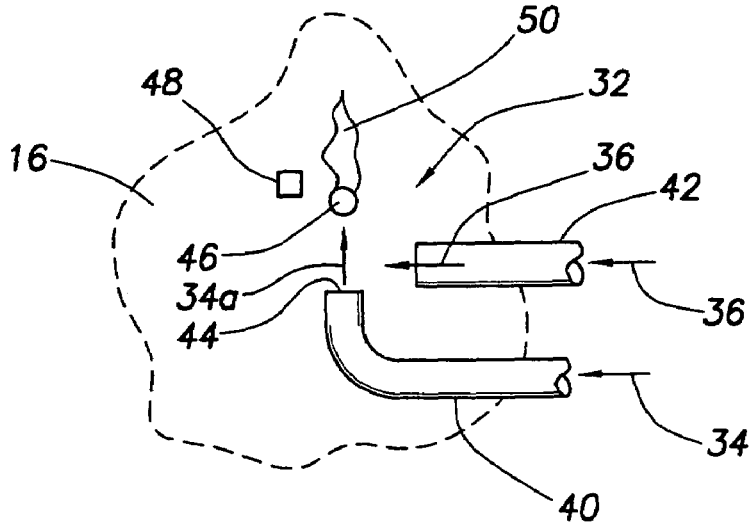
FIG. 2 is an enlarged scale schematic side elevational view of a raw fuel jet pilot portion of the water heater.

Pilot portion 32 of the overall fuel burner apparatus 28 is of a unique raw fuel jet construction and, from a conceptual standpoint, operates as schematically depicted in FIG. 2. Pilot portion 32, as previously mentioned, is disposed within the combustion chamber 16 and includes a fuel delivery tube 40 and an air delivery conduit 42, each of which extends into the combustion chamber 16 from exterior thereto. Fuel delivery tube 40 has an outlet opening 44 that underlies and faces a flame stabilization structure 46, which may representatively be a rod, wire or the like, positioned adjacent a suitable pilot ignition structure 48.

During operation of the pilot burner portion 32, a raw jet 34*a* of pressurized fuel 34 being flowed inwardly through the tube 40 is discharged from the outlet opening 44 onto the flame stabilizing structure 46. Raw fuel jet 34*a*, by aspiration, draws combustion air 36 from outside the combustion chamber 16 inwardly through the conduit 42 and causes it to mix with the fuel jet 34*a* for impingement therewith against the fuel stabilizing structure 46. This fuel/air mixture, when ignited by the pilot ignition structure 48, forms a stabilized pilot flame 50 on the downstream side (i.e., the upper side as viewed in FIG. 2) of the stabilizing structure 46. In this manner, conceptually embodying principles of the present invention, a stabilized pilot flame is created and maintained within the combustion chamber utilizing a raw fuel jet and primary combustion being delivered to the pilot burner portion essentially entirely from outside of the combustion chamber.

As later described herein, according to a feature of the invention, the fuel jet 34*a* has an elongated cross-sectional shape that provides the pilot flame 50 with enhanced stability despite minor relative orientation variations between the outlet orifice opening 44 and the pilot fuel jet target 46.

Figure 3:
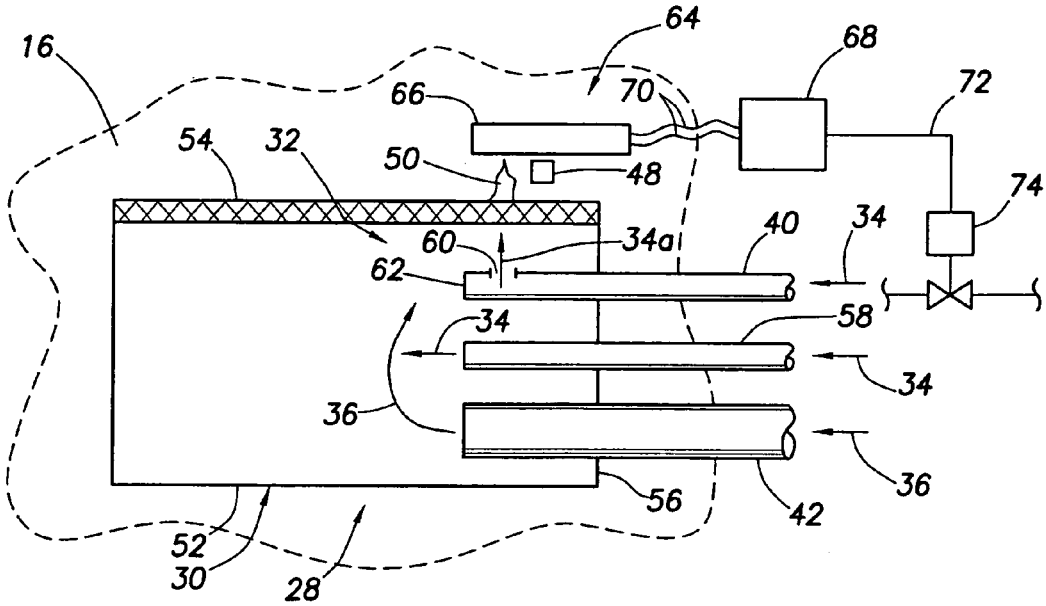
FIG. 3 is a schematic, partially sectioned side elevational view of a burner portion of the water heater incorporating therein the raw fuel jet pilot and an associated burner clogging detection system embodying principles of the present invention.

Schematically depicted in FIG. 3 is a representative structural embodiment of the fuel burner apparatus 28 operatively disposed within the combustion chamber 16. The main burner portion 30 of the fuel burner apparatus 28 is representatively a radiant fuel burner having a hollow body 52 with a flame holding upper side wall portion 54 illustratively formed from a metal wire mesh material. Alternatively, the flame holding wall portion 54 could be from another material having fuel/air discharge openings therein such as, for example, a ported wall structure, a porous ceramic wall construction, etc., and is not limited to the representatively illustrated metal wire mesh construction.

Extending inwardly through an inlet end wall portion 56 of the hollow main burner body 52 are the pilot burner fuel delivery tube 40, the air delivery conduit 42, and a main burner fuel delivery tube 58. The fuel delivery tube 40 has a side wall discharge port 60 (providing the previously described function of the tube outlet opening 44 conceptually illustrated in FIG. 2) positioned adjacent a closed inner end 62 of the tube 40 and in a downwardly spaced, facing relationship with an interior side surface portion of the metal wire mesh side wall portion 54 of the main burner body 52 adjacent its inlet end wall portion 56. While the main burner portion is representatively a radiant fuel burner, it will be readily appreciated by those of ordinary skill in this particular art that other types of main burners may be utilized without departing from principles of the present invention.

Figure 4:
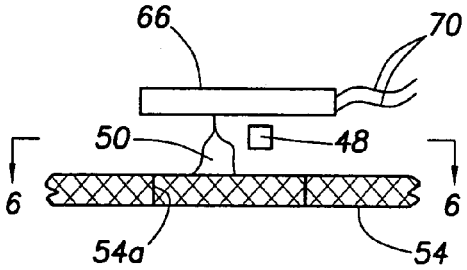
FIGS. 4 and 5 are enlarged scale schematic cross-sectional views through a flame-holding metal mesh wall of the FIG. 3 burner portion illustrating the operation of the burner clogging detection system.

During operation of the pilot burner portion 32 of the fuel burner apparatus 28, the raw fuel jet 34*a* is upwardly discharged from the fuel tube side wall discharge port 60, and is mixed within the main burner body 30 with combustion air 36 (from outside the combustion chamber 16) flowed into the burner body 30 via the air delivery conduit 42. The resulting fuel/air mixture 34*a*,36 impinges on an interior side surface of a portion 54*a* of the metal mesh side wall 54 (see FIG. 4), which defines the aforementioned flame stabilizing structure, and passes upwardly through the mesh portion 54*a*. When ignited by the igniter structure 48, the fuel/air mixture 34*a*,36 forms the pilot flame 50 on the upper (i.e., downstream) side of mesh portion 54*a* as illustrated in FIGS. 3 and 4. When the main burner 30 is lit (using combustion air 34 flowing inwardly through the conduit 42 and fuel 34 discharged into the burner body 52 through the tube 58), the pilot flame 50 becomes part of the overall main burner flame (not illustrated) on the outer side of the metal mesh material 54.

Figure 7:
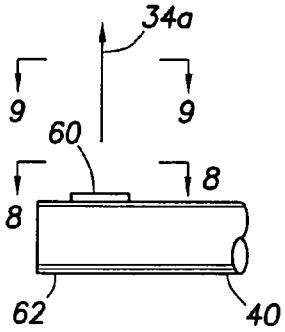
FIG. 7 is an enlarged side elevational view of a discharge end portion of the pilot fuel delivery tube shown in FIG. 3.
Figure 8:
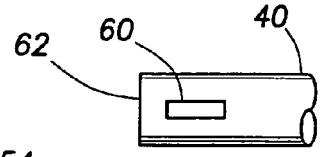
FIG. 8 is a top plan view of the tube end portion shown in FIG. 7, taken along line 8-8 of FIG. 7, and shows the elongated rectangular fuel discharge orifice therein.
Figure 9:
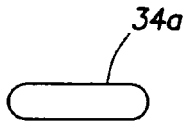
FIG. 9 is a cross-sectional view taken along line 9-9 of FIG. 7 through the schematically depicted cross-sectionally elongated raw fuel jet issuing from the elongated rectangular orifice.

Turning now to FIGS. 7-9, the previously mentioned fuel discharge port 60 (see FIG. 3) is an elongated fuel discharge orifice representatively having an elongated rectangular configuration, although a variety of alternate elongated configurations (such as an elongated oval configuration) could alternatively be utilized if desired. The elongated shape of the orifice 60 provides the discharged raw fuel jet 34*a* (see FIG. 9) with a corresponding cross-sectionally elongated shape which, as previously mentioned herein, provides the pilot flame 50 with enhanced stability despite minor relative orientation variations between the orifice 60 and the burner flame holding wall portion 54 which functions as a flame stabilizing structure.

The fuel burner apparatus 28 forms a part of an overall combustion system that includes the combustion chamber 16 and further includes a specially designed burner clogging detection system 64 that also embodies principles of the present invention. System 64 includes a thermocouple 66 positioned to be impinged upon by the pilot flame 50 during normal operation thereof, an electrical control circuit 68 operatively connected to the thermocouple by electrical leads 70 and in turn operatively coupled, as schematically designated at 72, to the gas supply valve 74 of the water heater 10.

Figure 5:
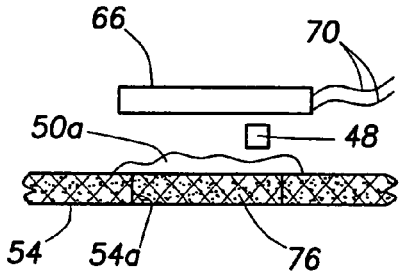

In the absence of clogging of the metal mesh area 54*a*, the pilot flame 50 (during non-firing periods of the main burner 30) has the concentrated (though cross-sectionally elongated) vertical configuration shown in FIGS. 3 and 4 and heats the thermocouple 66 sufficiently so that it permits continued fuel flow from the valve 74 to the fuel supply tube 40 to sustain the pilot flame 50. However, when the mesh area 54*a* becomes sufficiently clogged over time with particulate matter 76 (such as lint, dirt, oil and the like) as shown in FIG. 5, the shape of the pilot flame changes by horizontally spreading out and vertically shortening to its configuration 50*a* schematically shown in FIG. 5. This reduces the electrical output from the thermocouple 66 in a manner causing the gas valve 74 to close, thereby terminating the generation of the pilot flame 50 and also precluding fuel delivery to the main burner 30.

Figure 6:
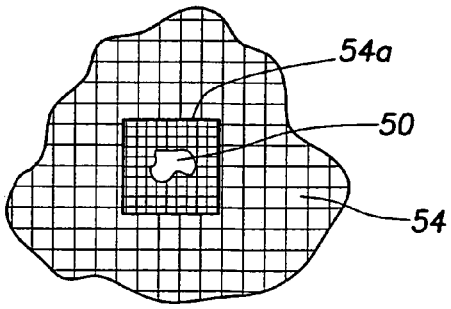
FIG. 6 is a schematic top plan view of part of the burner portion taken along line 6-6 Of FIG. 4.

To increase the sensitivity of the system 64 to particulate clogging of the burner 30, the mesh within the area 54*a* (see FIG. 6) may be provided with a considerably finer mesh spacing than that of the balance of the mesh 54. This makes the plugging detection function of the overall thermocouple-based system 64, which operates to monitor the shape of the pilot flame 50, more sensitive to such particulate clogging of the burner apparatus 28.

Compared to conventional pilot structures, the raw fuel jet-based pilot structure 32, which receives its combustion air from outside the combustion chamber 16, is simpler, uses less parts, uses less fuel and provides a more efficient pilot flame. Moreover, in a simple and efficient manner, the clogging detection system 64 functions to automatically shut down the water heater 10 when a burner clogging condition that may generate undesirable levels of carbon monoxide is sensed.

The foregoing detailed description is to be clearly understood as being given by way of illustration and example only, the spirit and scope of the present invention being limited solely by the appended claims.

What is claimed is:

1. Combustion apparatus comprising:

a wall structure defining a combustion chamber;

a main fuel burner disposed within said combustion chamber;

a pilot flame stabilizing structure disposed within said combustion chamber;

fuel delivery apparatus operable to receive fuel from a source thereof and discharge the received fuel in the form of a cross-sectionally elongated fuel jet that impinges against said pilot flame stabilizing structure; and air delivery apparatus through which combustion air from outside said combustion chamber is flowable to the discharged fuel jet to form therewith a fuel/air mixture ignitable to create a pilot flame extending outwardly from said pilot flame stabilizing structure.

2. The combustion apparatus of claim 1 wherein:

said pilot flame stabilizing structure is defined by a portion of said main fuel burner.

3. The combustion apparatus of claim 2 wherein:

said fuel jet passes through said portion of said main fuel burner.

4. The combustion apparatus of claim 3 further comprising:

a clogging detection system operative to sense a change in the shape of said pilot flame indicative of clogging of said main fuel burner and responsively prevent further generation of said pilot flame.

5. The combustion apparatus of claim 4 wherein:

said combustion apparatus further comprises a fuel valve operative to selectively permit fuel, from a source thereof, to flow through said fuel delivery apparatus, and said clogging detection system includes a thermocouple positioned to be impinged by said pilot flame and operative to close said fuel valve when said change in the shape of said pilot flame occurs.

6. The combustion apparatus of claim 2 wherein:

said main fuel burner is a radiant fuel burner.

7. The combustion apparatus of claim 1 wherein:

said combustion chamber is a water heater combustion chamber.

8. A method of creating hot combustion products in the combustion chamber of a fuel-fired heating appliance, said method comprising the steps of:

positioning a pilot flame stabilizing structure within said combustion chamber;

positioning a main fuel burner within said combustion chamber;

creating within said combustion chamber a cross-sectionally elongated fuel jet which impinges upon said pilot flame stabilizing structure;

mixing air from outside said combustion chamber with said fuel jet to form therewith a fuel/air mixture; and igniting said fuel/air mixture to create a pilot flame extending outwardly from said pilot flame stabilizing structure and useable to ignite a fuel/air mixture subsequently supplied to said main fuel burner.

9. The method of claim 8 wherein said method further comprises the step of:

utilizing a wall portion of said main fuel burner as said pilot flame stabilizing structure.

10. The method of claim 8 wherein:

said step of positioning a main fuel burner within said combustion chamber is performed by positioning a radiant fuel burner within said combustion chamber.

11. The method of claim 8 wherein:

said mixing step is performed within an interior portion of said main fuel burner.

12. The method of claim 11 wherein:

said mixing step includes the step of flowing air from outside said combustion chamber through an enclosed path into said interior portion of said main fuel burner.

13. The method of claim 9 wherein:

said wall portion of said main fuel burner has discharge openings therein, and said method further comprises the step of causing said fuel/air mixture to flow outwardly through said discharge openings, and said igniting step is performed in a manner causing said pilot flame to form on an outer surface of said wall portion of said main fuel burner.

14. The method of claim 13 further comprising the step of:

sensing a change in the shape of said pilot flame indicative of clogging of said main fuel burner and responsively preventing further generation of said pilot flame.

15. The method of claim 14 wherein:

said sensing step includes the step of causing said pilot flame to impinge upon a thermocouple.

16. The method of claim 15 wherein:

said responsively preventing step is performed by preventing said creating step from being performed.

17. A fuel-fired heating appliance comprising:

a combustion chamber thermally communicatable with a fluid to be heated;

a main burner disposed within said combustion chamber; and a pilot burner structure disposed within said combustion chamber for igniting said main burner and including:

a flame stabilizing structure disposed within said combustion structure;

fuel delivery apparatus operable to receive fuel from a source thereof and discharge the received fuel in the form of a cross-sectionally elongated fuel jet that impinges against said flame stabilizing structure; and air delivery apparatus through which combustion air from outside said combustion chamber is flowable through an enclosed flow path to adjacent the discharged fuel jet to form therewith a fuel/air mixture ignitable to create a pilot flame extending outwardly from said flame stabilizing structure.

18. The fuel-fired heating appliance of claim 17 wherein:

said fuel-fired heating appliance is a fuel-fired water heater.

19. The fuel-fired heating appliance of claim 18 wherein:

said fuel-fired heating appliance is a gas-fired water heater.

20. The fuel-fired heating appliance of claim 17 wherein:

said main burner has an outer wall portion with fuel/air discharge openings therein and interior and exterior surfaces, part of a section of said outer wall portion defining said flame stabilizing structure, with said fuel jet impinging on the interior surface of said part of said section and said pilot flame extending outwardly from the exterior surface of said part of said section.

21. The fuel-fired heating appliance of claim 20 wherein:

said outer wall portion of said main burner is of a metal mesh construction.

22. The fuel-fired heating appliance of claim 20 wherein:

said main burner is a radiant fuel burner.

23. The fuel-fired heating appliance of claim 20 further comprising:

a clogging detection system operative to sense clogging of said fuel burner and responsively prevent further generation of said pilot flame.

24. The fuel-fired heating appliance of claim 23 wherein:

said clogging detection system is operative to sense a change in the shape of said pilot flame indicative of clogging of said main burner.

25. The fuel-fired heating appliance of claim 24 wherein:

said fuel-fired heating appliance further comprises a fuel valve for selectively supplying fuel to said fuel delivery apparatus, and said clogging detection system further includes a thermocouple electrically coupled to said fuel valve and positioned to be impinged upon by said pilot flame.

26. The fuel-fired heating appliance of claim 20 wherein:

said section of said outer wall portion of said main burner is more susceptible to clogging by particulate matter than the balance of said outer wall portion of said main burner.

27. The fuel-fired heating appliance of claim 26 wherein:

said outer wall portion of said main burner is of a mesh construction, and the mesh spacing in said section of said outer wall portion is smaller than the mesh spacing in the balance of said outer wall portion.

28. Fuel combustion apparatus comprising:

a hollow burner body having an outer wall portion with fuel/air discharge openings therein;

a fuel delivery tube extending into the interior of said burner body, said fuel delivery tube being operative to receive pressurized fuel from a source thereof and discharge from an opening therein a cross-sectionally elongated fuel jet which impinges against the interior surface of said outer wall portion; and an air delivery conduit extending into the interior of said burner body and operative to deliver combustion air from a source thereof to the discharged fuel jet to form therewith a fuel/air mixture passing outwardly through discharge openings in a section of said outer wall portion and being ignitable to form a pilot flame extending outwardly from said outer wall portion.

29. The fuel combustion apparatus of claim 28 wherein:

said burner body is a radiant fuel burner body.

30. The fuel combustion apparatus of claim 28 further comprising:

a clogging detection system operative to sense clogging of said discharge openings and responsively prevent further generation of said pilot flame.

31. The fuel combustion apparatus of claim 30 wherein:

said clogging detection system includes a thermocouple positioned to be impinged upon by said pilot flame and operative to output a signal indicative of an undesirable shape of said pilot flame.

32. The fuel combustion apparatus of claim 30 wherein:

said fuel jet impinges on a part of a section of said outer wall which is more susceptible to particulate clogging than the balance of said outer wall.

33. The fuel combustion apparatus of claim 32 wherein:

said outer wall is of a mesh construction, and said section of said outer wall is of a finer mesh construction than the balance of said outer wall.

* * * * *